United States Patent [19]

Grindstaff

[11] Patent Number: 5,069,847

[45] **Date of Patent: * Dec. 3, 1991**

[54] IMPROVEMENTS IN PROCESS FOR PREPARING SPUN YARNS

[75] Inventor: Teddy H. Grindstaff, Kinston, N.C.

[73] Assignee: E. I. Du Pont de Nemours and Company, Wilmington, Del.

[ * ] Notice: The portion of the term of this patent subsequent to Dec. 3, 2008 has been disclaimed.

[21] Appl. No.: 420,457

[22] Filed: Oct. 12, 1989

Related U.S. Application Data

[63] Continuation-in-part of Ser. No. 228,800, Jul. 28, 1988, abandoned, which is a continuation of Ser. No. 934,200, Nov. 21, 1986, abandoned.

[51] Int. Cl.[5] ..... D01F 6/62; D01F 11/04

[52] U.S. Cl. ..... 264/103; 264/129; 264/130; 264/134; 264/136; 264/210.3; 264/210.8; 264/168; 264/151; 264/211.15; 264/235.6; 264/346

[58] Field of Search ..... 264/211.14, 129, 103, 264/130, 134, 136, 151, 168, 210.3, 210.8, 211.15, 235.6, 346

[56] References Cited

U.S. PATENT DOCUMENTS

| | | | |
|---|---|---|---|
| 3,110,617 | 11/1963 | Scott | 427/175 |
| 4,316,924 | 2/1982 | Minemura et al. | 428/89 |
| 4,396,389 | 8/1983 | Löfgren | 8/115.5 |

FOREIGN PATENT DOCUMENTS

| | | |
|---|---|---|
| 3324662 | 7/1982 | Fed. Rep. of Germany . |
| 1189299 | 10/1959 | France . |
| 47-35608 | 9/1972 | Japan . |
| 49-1257 | 1/1974 | Japan . |
| 55-4845 | 2/1980 | Japan . |
| 56-31073 | 3/1981 | Japan . |
| 56-140167 | 11/1981 | Japan . |
| 58-169512 | 12/1983 | Japan . |
| 58-180672 | 1/1984 | Japan . |
| 61-231218 | 3/1987 | Japan . |
| 839456 | 6/1960 | United Kingdom . |
| 850169 | 9/1960 | United Kingdom . |
| 1093628 | 12/1967 | United Kingdom . |
| 1276329 | 6/1972 | United Kingdom . |

OTHER PUBLICATIONS

Hermann Ludewig, Polyester Fibers—Chemistry and Technology, 1964; Engl. Transl. 1971; John Wiley & Sons Ltd.; pp. 387–389.

*Primary Examiner*—Hubert C. Lorin

[57] ABSTRACT

Solid polyester fiber in spun yarns, and fabrics and garments and precursor staple fiber and filamentary tow, are prepared by an improved process involving treatment of freshly-extruded undrawn polyester filaments with caustic in the spin-finish, so as to improve moisture-wicking properties.

5 Claims, No Drawings

IMPROVEMENTS IN PROCESS FOR PREPARING SPUN YARNS

CROSS-REFERENCE TO RELATED APPLICATIONS

This application is a continuation-in-part of copending application Ser. No. 07/228,800, filed July 28, 1988, now abandoned which itself is a continuation of application Ser. No. 06/934,200, filed Nov. 21, 1986, now abandoned.

TECHNICAL FIELD

This invention concerns improvements in and relating to spun yarns of the polyester type, and more particularly to such yarns whose fibers have been modified to provide entirely new properties, and including precursor tows and staple fiber, and to textile articles such as fabrics and garments containing such yarn and/or fiber.

BACKGROUND OF THE INVENTION

Synthetic polyester yarns have been known and used commercially for several decades, having been first suggested by W. H. Carothers, U.S. Pat. No. 2,071,251, and then by Whinfield and Dickson, U.S. Pat. No. 2,465,319. In particular, polyester staple fiber has been an industrial commodity that has been manufactured and used in such textile yarns on a very large scale, primarily in blends with natural fibers, especially cotton, such blends having been spun (twisted) into spun yarns that have been made into textile fabrics, and eventually into garments and other textiles. Practically all such polyester staple fiber has been of round cross-section and solid, as opposed to hollow; references herein to solid refer to such solid cross-section. Such staple fiber is generally of average denier about 1½ and of cut length about 1½ inches, but the average denier and cut length can vary up to about 3 and down to about 1, and the ratio of average denier to cut length is generally about 1 and less than 2:1. Polyester staple fiber has been recognized as having significant advantages over cotton in some respects, for instance its thermoplastic characteristics that enable polyester-containing fabrics to hold their shape, for instance a crease, and to have wash-wear characteristics, their greater uniformity, which provides processing advantages and their superior strength and resistance to degradation. However, hitherto, some people have expressed a preference for wearing garments from cotton fibers because of attributes that can be summarized as "comfort", to the extent that there has been a trend recently towards reducing the content of polyester in blends, and even to using more 100% cotton fabrics, despite the practical advantages of wash-wear 100% polyester and blended fabrics. Because of the sophistication of the textile industry, both of the polyester fiber manufacturing industry and of downstream consumers of textiles, and because of the commercial interest in providing apparel and fabrics that will perform well during actual use by the ultimate consumer (wearer), much attention has been devoted to analyzing appropriate requirements. Many technical papers, for example, have been published on various aspects, and patents have been issued with the objective of improving the "comfort" that can be obtained from textile articles, and their constituents, and the literature has been replete with these suggestions for several years. So it has long been considered desirable to improve various properties of polyester-containing textiles, and of the yarns and polyester staple fibers, themselves, and much effort has been devoted in the textile industry towards this objective.

An important objective of my invention is to provide such polyester staple fiber, or its precursor tow, in a new form such that it can be formed into spun yarns, which can then be formed into fabrics and garments that can show improved moisture-wicking properties, as discussed hereinafter.

Polyester filaments are characterized by their extreme hydrophobic character, as mentioned in "Polyester Fibres—Chemistry and Technology", by H. Ludewig—English translation 1971—John Wiley and Sons, Ltd., in Section 11.1.5 on pages 377–378, and also in Section 11.4 on dyeing properties, starting on page 398. Indeed, the difficulty of dyeing polyester yarns and fabrics is notorious. Ludewig's book mentions many aspects of polyester fibers and their preparation and properties.

Polyester staple fiber has generally been manufactured commercially by a process of melt-spinning (i.e. extruding molten polyester polymer) into a bundle of filaments, collecting such filaments into a tow, which can be relatively small and converted directly, e.g. by stretch-breaking, into a spun yarn, but has more often been extremely large, amounting to many thousand and even some million(s) of filaments, and this tow has then been processed by drawing, and possibly annealing, and crimping, before the crimped filaments have been converted into staple fiber by cutting, or otherwise, to the desired lengths. As indicated, most polyester staple fiber has then been blended, e.g. with cotton, and converted into yarn, which is generally referred to as a spun yarn, to distinguish it from a continuous filament yarn.

It is conventional to coat the freshly-extruded filaments with a "finish", which is generally an aqueous emulsion comprising a lubricant and an antistat. Finishes are discussed briefly in Section 5.5, starting on page 193 of Ludewig, referred to above As mentioned on page 195, the literature reveals relatively little about the compositions of the spin-finishes that are actually used. Although there is now considerable patent and other literature, the precise finish formulations are generally closely-guarded secrets by the yarn manufacturers, and different compositions are formulated for different purposes, depending on the particular intended processing and possible specific requests by individual customers, and these formulations change, sometimes quite frequently. As will be related hereinafter, a dramatic change in the surface properties of the fibers, and of articles containing them, such as yarns, fabrics and garments, has been obtained in effect by a relatively simple modification of the spin-finish that is applied to the freshly-extruded polyester filaments. Conventionally, the spin-finish is the first contact that a freshly-extruded filament encounters after solidification. The finish was generally applied by a finish roll, rotating in a bath of the finish, so that the filaments pass through the finish emulsion as they brush past the finish roll on their way from the solidification zone to the feed roll that determines the withdrawal speed from the spinneret. Before the finish roll, it is generally desirable to avoid or minimize contact between the filaments and solid objects, and so the only other closely-adjoining solid objects are generally guides that are intended to confine the filaments before contacting the finish roll. A finish roll is not the only method of applying finish, and other methods have been used and suggested, including spraying or metering the finish onto the filaments.

SUMMARY OF THE INVENTION

I have now found that the moisture-wicking properties of drawn polyester fibers in textile fabrics and garments can be significantly changed by adding a small amount of caustic soda to the spin-finish, so that the caustic can modify the surface of the filaments as they are freshly extruded. This change has caused the polyester surface to be modified and have improved moisture-wicking properties, after washing. It is surprising that this long-desired improvement can be achieved by such a small change in the conventional process, and that this has not been reported hitherto, so far as I know, despite the many references in the literature to treatments, especially of fabric, with caustic soda among other materials.

Accordingly, there is provided an improvement in a process for preparing textile spun yarns from staple fiber of solid cross-section, comprising the steps of melt-spinning polyester into solid filaments, preferably at withdrawal speeds of the order of about 1 km/min. or more, treating the freshly-extruded filaments with a spin-finish and collecting them in the form of a bundle, further processing such filaments in the form of a tow, if desired, by drawing and possibly annealing to increase orientation and crystallinity, crimping to produce crimped filaments, converting such crimped filaments to staple fiber and forming a spun yarn therefrom, the improvement characterized by treating the freshly-extruded polyester filaments with a small amount of caustic, in sufficient amount and sufficiently rapidly so as to modify the surface of the polyester, so as to improve their moisture-wicking properties, when washed, and the resulting spun yarns that are new and improved in that their polyester fibers have such modified surface, and blended yarns, consisting essentially of such improved surface-modified polyester staple fiber blended with other fibers.

There are also provided according to other embodiments of the invention, precursor tows and staple fiber, and downstream articles, such as fabrics and garments incorporating such spun yarns or staple fiber, as described hereinafter, wherein the surface of the polyester fiber has been modified to improve moisture-wicking by such treatment of the freshly-extruded filaments with caustic soda, and by washing.

DETAILED DESCRIPTION OF THE INVENTION

For convenience, despite the fact that the surface has been changed, so that the moisture-wicking characteristics are not what has hitherto been associated with "polyester" fibers and yarns, I shall refer to both treated and untreated materials by the term "polyester", for reasons which will be apparent. I shall also refer mainly to caustic soda, although I know that other bases such as lye (KOH) can also render polyester filament surfaces hydrophilic.

The preparation of a polyester filamentary tow may be carried out conventionally except for the application of caustic soda to the freshly-extruded filaments, and then the treated filaments may be processed conventionally, with conversion into staple fiber and into spun yarns, and eventually fabrics, e.g. by knitting or weaving, and garments. Generally, hitherto, undrawn polyester filaments have been prepared by melt-spinning, and the undrawn filaments have been collected into a tow, which is subsequently processed by drawing, and if desired, annealing, followed by crimping and relaxing and drying before conversion to staple fiber and subsequent conversion into spun yarns. According to the invention, this conventional process is modified by treating the freshly-extruded filaments with caustic. As indicated, this is most conveniently effected by adding an appropriate amount of caustic soda to the finish that is applied to the freshly-extruded filaments, since the application of finish is essentially the first treatment or contact that the freshly-extruded filaments encounter after solidification. It is important, according to the invention, that this treatment with caustic be effected on these freshly-extruded filaments, which are often referred to as "live" filaments. The effect appears to be different from that obtained if caustic soda is applied at a later stage to the fabrics containing drawn fibers, according to prior art teaching. Also, if the application of the caustic is delayed, or not sufficiently prompt, then caustic will not be effective in providing a significant improvement in moisture wicking. This is shown at the end of the Example, hereafter.

Precautions need to be taken and modifications must probably be made to avoid or minimize corrosion or other contamination and other disadvantages that may result because of the use of caustic according to the invention. For such reasons, hitherto, it has been considered highly undesirable to include any dangerous or corrosive material, such as a caustic alkali, even in the small amounts indicated, at this stage of the process. This is at least one reason why, so far as I know, hitherto, there has previously been a prejudice against the use of a material such as caustic soda at this stage of a process for preparing polyester staple fibers for use in spun yarn, and in fabrics and garments thereof. In this regard, it should be recognized that the filaments travel at relatively high speeds (of several hundreds of meters per minute) so that it is difficult to avoid 'slinging', i.e., release of droplets of finish from these high speed filaments after application of the finish.

In order to obtain the improvement in moisture-wicking, the fiber surface must be washed. This is generally most conveniently effected by washing the eventual fabrics or garments, and is believed to have the effect of removing the sodium ions. As indicated later, if the desired hydrophilic properties are lost, they may be revived by washing the fabric in a commercial material such as TIDE, followed by rinsing.

At this time, I generally measure the effectiveness of the treatment according to the invention by measuring the Carboxyl Equivalent (CE) of the surface on the weight of the drawn fiber, since I speculate that the improved comfort properties may correlate with at least a threshold value of such surface carboxyl equivalents, i.e. carboxyl groups on the surface of the filament or fiber. This is because it appears that there has been a chemical change to the surface of the filament or fiber, from its regular hydrophobic nature, that has been a characteristic of polyester as reported, e.g. by Ludewig. The surface of any textile fiber is believed to be the key to most aesthetic properties, so this change is extremely important. The core appears to be relatively unchanged from regular polyester polymer, whereas the surface has been significantly changed so that the yarn, fabric and garments show improved moisture-wicking properties. Since the treatment is applied to the surface of the freshly-extruded filament, which is undrawn, and this filament is then subjected to a drawing process, in which the surface of the filament is significantly increased, which must mean that new surface is created from polymer that had previously been concealed beneath the surface of the undrawn filament, it is extremely surprising that the improvement in properties are shown in the fabrics and garments, that contain drawn material, whereas it was the undrawn filament that was treated with caustic soda. Indeed, we have found that the CE value is higher for the drawn filament than for the undrawn filament.

I believe that the comfort of a fabric of spun yarns correlates to some extent with the moisture-wicking capability, in other words the ability of the fibers to wick water away from the skin of the wearer of any garment. In this respect, the behavior of 100% cotton fabrics and 100% conventional polyester fabrics are completely different. When one drops a small amount of water on a clean cotton fabric, the water is practically instantaneously absorbed. In contrast, the water will not be absorbed by clean conventional 100% polyester fabric, but the water will remain on the surface of the polyester until it evaporates, i.e. for a period that will depend on the atmospheric conditions. When the same test is applied to a clean fabric of 100% surface-modified polyester according to the invention, however, the water is almost instantaneously absorbed; this behavior is comparable with that of cotton, and is in stark contrast with the behavior of conventional polyester.

In fact, use of hydrophobic fiber, such as polyester, that does not absorb water, and that has a surface with good moisture-wicking capability, should provide more "comfort" than cotton, because the water will not be absorbed by the hydrophobic core of the polyester. In contrast, cotton absorbs water, which can be a disadvantage, as the water will be retained longer, so the fabric and garment can feel wet and clammy in comparison.

I have found that the improvement in moisture-wicking characteristics over conventional polyester has been remarkably durable, even after repeated washings, and some temporary or apparent decrease from the original characteristics, as observed by rapidity of absorption of a water drop, after repeated rinsings, has been repaired by washing the fabric again in a suitable detergent such as "TIDE", and rinsing again, which apparently revives the hydrophilic characteristics. This experience is similar to that with cotton fabrics, which can appear to become hydrophobic after washing in a cationic material such as "DOWNY", because of absorption of particles onto the cotton, but the hydrophilic properties can be revived by washing in a material such as "TIDE", followed by rinsing, to remove the sorbed moieties responsible for the apparent (and temporary) hydrophobic characteristics. (For a proper comparison of the moisture-wicking ability of a fabric, any finish or oil should be removed first, otherwise the particular finish may confuse the results). An increase in moisture-wicking characteristics correlates with an increase in the capillary rise, which correlates with a decrease in contact angle, as measured, e.g., according to the procedures described by T. H. Grindstaff in Textile Research Journal (October 1969), Volume 39, pages 958–962 and (October 1975), Volume 45, pages 760–761.

I have found that it is desirable to provide the polyester with at least 0.2 CE (surface carboxyl equivalents per 10<grams of drawn fiber). This level is almost twice the background level, generally 0.12–0.13 CE, of regular polyester. It will be understood that the wicking action is better with higher levels, such as at least 0.3 CE, and even more, such as 0.5 CE. However, so far as wicking is concerned, I have not seen an appreciable improvement with 0.75 CE over 0.5 CE, although such higher surface carboxyl equivalent could possibly show a further advantage in comfort for the wearer of a garment. It is undesirable to use unnecessarily high amounts of caustic soda (i.e. beyond that desirable to obtain the desired improvement in comfort), because the use of more caustic generally leads to more problems, more cost and more potential disadvantages that it is desirable to avoid or minimize. As will be understood, the amount used in practice will be very much an empirical matter, depending on one's desires, the equipment used, and any difficulties that arise in processing.

I have found that the increase in surface carboxyl content (CE) has been generally linearly related to the pick-up of caustic on the undrawn polyester filament, when comparing otherwise similar treatments. However, as mentioned herein, since this effect seems to occur only with "live" filaments that have been freshly-extruded, sufficient caustic should be used to contact all the desired filaments sufficiently quickly to obtain the desired improvement. For this reason, in Example 1, with my experience on the filaments of the type used, I used sufficient for the freshly-extruded filaments to pick-up an amount of caustic soda, based on the weight of the filaments, corresponding to about 0.4 CE. The amount of caustic picked up by the filaments will depend on the concentration of caustic in the finish, and on the amount of finish picked up by the filaments, which I have found can vary widely, depending on the method of application, the characteristics of the finish and the characteristics of the filaments. Thus, one first determines the amount of wet pick-up of total finish by the filaments, and then arranges the concentration of caustic in the finish so as to provide the desired amount of caustic on the filaments. I have used sufficient caustic to pick-up about 0.05 to about 0.15%. I have found that as little as 0.2% pick-up leads to further problems in processing, and even less is preferable, depending on the processing equipment. However, such problems can be overcome by modifications to apparatus and techniques, and it may later prove desirable to increase the pick-up of caustic further, if this leads to advantages in fabrics and garments. Even such higher amounts of caustic pick-up, however, would be entirely different from the prior art treatment of soaking of articles (especially fabrics) in hot caustic soda, even if the concentrations of caustic may be superficially similar. I should also caution that, since I have been working with freshly-extruded filaments and cut fiber as disclosed in the Examples, and since this is a surface phenomenon, when the dimensions and quantities of the treated filaments are changed significantly, adjustments have had to be made to the quantities of caustic to achieve the same desired effect, as can be noted from copending cases, referred to herein.

I have tried to obtain the same effect by winding up a group of undrawn filaments, without any finish, and then applying (by weight) about 0.4% FOY of an aqueous solution containing 3.5% of finish and containing 1% caustic to such undrawn filaments, before drawing. The treated filaments were allowed to age for more than two days before drawing. I found that such caustic treatment did not significantly change the contact angle of these filaments, after drawing, nor improve their wicking characteristics. Furthermore, as will be seen hereinafter, depending on the equipment and conditions used, probably especially the speed of the filaments, and/or their rate of cooling, the advantageous effects of the invention may not be achieved because such filaments have not been treated when fresh enough. This has not been a problem on our commercial spinning equipment, using speeds of more than 1 km/min., and may not prove a problem for others when spinning under their normal commercial conditions, and I can only speculate whether such problem is caused by excessive delay and/or cooling or any other condition, but it seems that the problem can be solved provided the filaments are sufficiently freshly-extruded. Moreover, although I have found it convenient to apply the caustic to the freshly-extruded filaments in a spin finish, now that the advantage of the improved comfort obtainable by this technique has been recognized, it is expected that alternative procedures can be devised, and may not even require application to freshly-extruded filaments. For instance, polyester fiber having a surface that is in all essential respects equivalent to a freshly-extruded filament, in the sense of the present invention, can possibly be recreated artificially, although this is still speculation. Indeed, much of my knowledge herein is still speculation, and it is possible that the subsequent drawing process has an importance, the exact nature of which has not yet been recognized.

It is to be expected that other materials than caustic soda can be used to give a similar effect. Indeed, application Ser. No. 934,221 and copending application Ser. No. 420,458 filed simultaneously herewith, describe polyester filament yarns that have been surface-modified by a similar treatment using lye (KOH) instead of caustic soda, to render such filaments hydrophilic, so it is to be expected that other alkali metal hydroxides and alkaline earth metal hydroxides, especially $Ca(OH_2)$, or equivalent basic materials, may give an essentially equivalent effect. However, it is noted that the mercerizing effect of caustic soda on fabrics is not exactly the same as the effect of caustic potash, so there may be variations in the precise results obtained.

The effect of the invention is different from that of mercerizing, i.e. the effect of soaking fabrics or drawn yarns in hot strong NaOH, such as been described by Ludewig and others, whereby a significant amount of the fiber is removed as if it was peeled away. Such treatment wastes a significant amount of the polyester and leaves a very different surface, which is extremely rough when examined under high magnifications, and this roughness (under high magnification) produces lower fiber-to-fiber friction. In other words, the fibers can slip by each other more easily. This can be a desirable effect, especially if the treatment is applied to the fabric, but produces processing difficulties if such treatment is applied to fibers, such difficulties being encountered especially in forming spun yarns from such fibers of low fiber-to-fiber friction. In other words, a mercerizing-type treatment provides a different result in regard to the surface roughness, and is often undesired.

The invention is further described with reference to the following Example:

ANALYSIS FOR SURFACE CARBOXYLS (CE)

The procedure for poly(ethylene terephthalate) yarn or fabric is as follows, and may be adapted for other textile articles or materials:

1. A stock solution of dye is made up by dissolving 2.0 g of Fuchsine in 500 ml of distilled water containing 5 ml of glacial acetic acid.

2. Samples of yarn or fabric weighing approximately 1 g are prepared free of finish or sizing.

3. With each yarn or fabric sample, 5 ml of stock dye solution and 180 ml of distilled water are added to a wide mouth jar, which is capped.

4. The tightly-capped jar is fastened in a special clamp attached to a motor shaft and tumbled slowly end-over-end for 30 minutes at room temperature. For a larger number of samples, other methods of agitation may be devised.

5. The fiber samples are given quick rinses in five changes of cold water and dried.

6. The dried samples are weighed, then extracted with three or four 20–25 ml portions of warm methanol/acetic acid (90/10). These portions are combined and diluted with sufficient methanol/acetic acid to provide 100 ml.

7. Absorbances (Optical density) are read in a 5 cm cell at the 555 mμ maximum.

8. For these Fuchsine dyeings (molecular weight used=324, extinction coefficient=240.5) which have been diluted to 100 ml and read in a 5 cm cell, the number of carboxyl equivalents/$10^6$ g of fiber (CE) is calculated as follows:

$$CE = 0.2566 \times \text{Absorbance/Fiber Weight}$$

At this point, reference is made to my copending applications Ser. No. 07/266,712, filed Nov. 3, 1988 and 07/368,844, filed June 20, 1989, directed to staple fiber of intentionally mixed denier, and yarns and other articles made therefrom, the disclosures of which are incorporated herein by reference, since the present invention has been found particularly advantageous as applied to such yarns, fabrics therefrom and precursor filamentary tows and staple fiber. The following. Example was carried out using essentially the same procedure and similar apparatus, except as indicated hereinafter.

EXAMPLE 1

An intimate mixture of approximately equal numbers of polyester staple fiber (relative viscosity 28, LRV 21) of about 1½ and about 3 dpf was obtained by a process, as described with reference to FIG. 4 of copending application Ser. No. 07/266,712, involving conventionally melt-spinning to form a bundle of filaments, combining several bundles to form a large bundle, i.e. a small tow, drawing/annealing and crimping the tow, and converting the tow to staple fiber by cutting, except that the large bundle (tow) contained intimately mixed filaments of different dpf made by spinning through orifices and capillaries with different throughput on the same spinning machine, and except that NaOH was added to the spin finish in a concentration of 1%, by weight of the finish, to provide a pick-up of NaOH on the filaments of 0.13%. The orifices were circular to provide filaments of round cross section. The smaller filaments (spun denier 4.16, natural draw ratio 1.61) were spun on one side, on 18 positions, each having 1590 orifices of diameter 15×30 mil (about 0.38×76 mm) under a pack pressure of 2500 psig at a throughput of 0.101 lbs. per hour. The larger filaments (spun denier 6.85, natural draw ratio 1.65) were spun through similar orifices, but under a pack pressure of 3000 psig at a throughput of 0.166 lbs. per hour, on the other side, on 23 positions, each having 1176 orifices. All these filaments were spun at a withdrawal speed of 1800 ypm. The tow, amounting to about 56,000 filaments, was drawn at a draw ratio of 2.95×, to give drawn filaments of bundle tenacity 3.75 g/d, and dry heat shrinkage about 6–7%, crimped to give about 9 crimps per inch, and cut to a cut length of 1½ inches, to give staple fiber with a finish level of 0.07% by weight, and 0.5 CE. The nominal denier was 2.25, but about half the filaments/fibers were of 1½ denier and the other half of 3 denier.

As mentioned in my copending applications Ser. No. 07/266,712 and 07/368,844, garments from the spun yarns therein are believed to provide soft, dry, cool and airy aesthetics, and more breathability as a result of the mixed denier feature, which in that Example was from a knit fabric. Fabrics, especially woven fabrics, from the surface-modified fibers of this Example blended with cotton are expected to give even more of the same advantages (as compared with prior art polyester that has not been surface-modified), especially where the improved moisture-wicking is important, such as coolness and dryness. Thus, the percentage of cotton in such blends may be reduced, without such significant loss of comfort as would be experienced using conventional polyester. Similarly, 100% polyester fabrics and garments thereof are expected to give improved comfort over conventional prior art polyester.

The above filaments were prepared on spinning machines at a withdrawal speed of about 1800 ypm (about 1,650 meters/min), as indicated, with the finish roll located 148 inches (about 3.75 meters) distant from the spinneret, and with an essentially radial quench system supplying 365 scfm of room temperature air.

When, however, filaments were spun on a small laboratory machine at a speed of 285 ypm (about 260 meters/min) and with the finish roll at a distance of 48 inches (about 1.2 meters) from the spinneret, and a cross flow quench system supplying an undetermined amount of air, the CE value of the yarns was significantly diminished, and the results were not as desired. Furthermore, despite efforts at changing the conditions, such as turning off the cooling air and insulating the filaments so as to minimize cooling by external air, although the CE values were sometimes slightly larger than a control (without caustic in the spin finish), inconsistent results were obtained, and the advantages of the invention were not obtained, leading me to the conclusion that, using these laboratory spinning conditions, in contrast to the conditions described in the Example hereinbefore, the caustic spin finish was not applied to the filaments when they were sufficiently fresh, in the sense of freshly-extruded.

EXAMPLE 2

Polyester fiber was prepared essentially as described in Example 1, except that NaOH was added to the spin finish in a concentration of 0.5%, by weight of finish, to provide a pick-up of NaOH on the filaments of 0.05%. The fiber was processed essentially as described above to give a 0.2 CE. The nominal denier was 2.25, but about half of the filaments were of 1½ denier and the other half of 3 denier. The lower NaOH pick-up reduces corrosion during further processing of the fiber, which can be an advantage.

Although filaments (and cut fibers) of intentionally mixed denier were used in these Examples, the invention is not limited to this embodiment, and conventional average deniers may be used, e.g. of about 1 or less, up to about 3 or more, and conventional cut lengths (as disclosed in the copending application) for making spun yarns and fabrics and garments therefrom, using conventional techniques. The filaments may be round or of other cross-sections, such as scalloped-oval, or trilobal, if desired, but should be solid, as indicated, as opposed to hollow in cross-section. Although much emphasis has been put herein on the surface-modification of freshly-extruded filaments and staple fiber destined for conversion into spun yarns, because this has hitherto been the largest commodity use of conventional prior art polyester staple fiber in textile articles, such as knitted or woven textile fabrics and garments thereof, it will be recognized that a corresponding increase in comfort can also be advantageous in any other textile materials or articles that include conventional polyester staple fiber. For instance, surface-modified polyester staple fiber according to the invention may be used as flock, or in dry-laid non-woven fabrics, with advantages, because of the improved comfort or aesthetics resulting from the improved moisture-wicking ability over conventional polyester fiber, especially when used in a surface of the fabric; for such uses, staple fiber is generally uncrimped. For these other uses, the staple should be of conventional characteristics (other than the surface modification) according to the invention. For instance, unlike staple for spun yarn, such staple is generally uncrimped, and of different dimensions. Preferably, such textile fabrics and garments should contain a significant amount of surface-modified polyester for the advantage to be noticeable, and this amount will generally depend on various considerations, such as the amount of polyester desired, the nature of the fabric, its construction and its intended use and desired aesthetics, but should generally be of the order of 10% by weight, although in some cases even 5% by weight may prove advantageous. Preferably, much larger quantities, such as 25% or more, 50% or more, 75% or more, and 100% will provide greater advantage from the invention.

Although conventional polyester, i.e. poly(ethylene terephthalate) was used in the Example, other polyesters, such as copolymers, e.g. with dye-modifiers, may be used, and the relative viscosity may, if desired, be of low viscosity for low pilling characteristics, and changes may be made accordingly to correspond with such changes to the polymer, e.g. in the methods of preparation and testing. The advantage of the invention is that the normal hydrophobic surface is significantly changed by the simple treatment of freshly-extruded filaments with caustic according to the invention, and the invention is not considered restricted by the nature of the polyester polymer, nor by the cross-section or configuration of the filaments. Indeed, I believe that certain copolymers and special configurations may respond somewhat more easily to surface modification than those in the Example.

The following Example shows application to a copolymer using a specific copolymer of fiber grade molecular weight.

Example 3

A copolymer (LRV 24.5) of 83 mole % polyethylene terephthalate and 17 mole % polyethylene hexahydroterephthalate was spun in a conventional manner using a spinneret temperature of 270° C. and wound up at 1450 ypm to give a yarn having 900 filaments and an overall denier of 2850. Between the spinneret and the wind up, the spun yarn contacts a finish roll which applies spin finish to the filaments. The spin finish is composed of a 3.5% (by weight) aqueous emulsion of an anionic surfactant and nonionic lubricant and having 1.6% (by weight) of sodium hydroxide dissolved in the aqueous phase. The wet pick-up of the spin finish on the spun yarn was 4.0% (by weight) giving a concentration of NaOH deposited on the yarn of 0.064% based on the weight of yarn.

Bundles of yarn were collected together forming a tow, of approximately 54,000 filaments, which was drawn, annealed, crimped, and cut. The fibers were drawn at a ratio of 2.78× and annealed at 180° C. to give a drawn fiber with a single filament tenacity of 5.3 grams per denier with an elongation of 16–18%, crimped to about 10 crimps per inch, and cut to 1½ inches, to give a staple fiber with a finish level of about 0.08% by weight, and a 0.48 CE. The nominal denier of the fiber was 1.3 denier per filament.

I claim:

1. An improvement in a process for preparing textile spun yarns from staple fiber of solid cross-section, comprising the steps of melt-spinning polyester into filaments that are quenched as they are withdrawn from the spinneret at a speed termed the withdrawal speed, treating the freshly-extruded filaments with a spin-finish and collecting them in the form of a bundle, further processing such filaments in the form of a tow, if desired, by drawing and possibly annealing to increase orientation and crystallinity, crimping to produce crimped filaments, converting such crimped filaments to staple fiber and forming a spun yarn therefrom, wherein the improvement consists in treating the freshly-extruded polyester filaments with a spin-finish containing an amount of caustic selected and at a location selected such that, in combination with the withdrawal speed and quenching conditions, the caustic treatment is sufficiently soon so as to modify the surface of the polyester, so as to improve the moisture-wicking properties, after washing, as indicated by the polyester having at least 0.2 surface carboxyl equivalents per million grams of drawn fiber.

2. A process according to claim 1, wherein the said staple fiber is blended with other fibers so that the spun yarn consists essentially of a blend of surface-modified fibers and said other fibers.

3. An improvement in a process for preparing filamentary tow of solid cross-section, comprising the steps of melt-spinning polyester into filaments that are quenched as they are withdrawn from the spinneret at a speed termed the withdrawal speed, treating the freshly-extruded filaments with a spin-finish and collecting them in the form of a bundle, and further processing such bundle in the form of a tow, if desired, with drawing and possibly annealing to increase orientation and crystallinity, if desired with crimping to produce crimped filaments, wherein the improvement consists in treating the freshly-extruded polyester filaments with a spin-finish containing an amount of caustic selected and at a location selected such that, in combination with the withdrawal speed and quenching conditions, the caustic treatment is sufficiently soon so as to modify the surface of the polyester so as to improve the moisture-wicking properties, after washing, as indicated by the polyester having at least 0.2 surface carboxyl equivalents per million grams of drawn fiber.

4. An improvement in a process for preparing staple fiber of solid cross-section, comprising the steps of melt-spinning polyester into filaments that are quenched as they are withdrawn from the spinneret at a speed termed the withdrawal speed, treating the freshly-extruded filaments with a spin-finish and collecting them in the form of a bundle, and further processing such bundle in the form of a tow, if desired, with drawing and possibly annealing to increase orientation and crystallinity, if desired with crimping to produce crimped filaments, and converting such filaments into staple fiber, wherein the improvement consists in treating the freshly-extruded polyester filaments with a spin-finish containing an amount of caustic selected and at a location selected such that, in combination with the withdrawal speed and quenching conditions, the caustic treatment is sufficiently soon so as to modify the surface of the polyester so as to improve the moisture-wicking properties, after washing, as indicated by the polyester having at least 0.2 surface carboxyl equivalents per million grams of drawn fiber.

5. A process according to any one of claims 1, 2, 3 or 4, wherein the freshly-extruded polyester filaments are treated so that the polyester has at least 0.3 surface carboxyl equivalents per million grams of drawn fiber.

* * * * *